US006835518B2

(12) United States Patent
Tachi et al.

(10) Patent No.: US 6,835,518 B2
(45) Date of Patent: Dec. 28, 2004

(54) TONER FOR ELECTROSTATIC IMAGE DEVELOPMENT

(75) Inventors: Hidenori Tachi, Wakayama (JP); Yasuyuki Tamane, Neyagawa (JP); Koji Akiyama, Wakayama (JP); Hiroyuki Kawaji, Wakayama (JP)

(73) Assignee: Kao Corporation, Tokyo (JP)

( * ) Notice: Subject to any disclaimer, the term of this patent is extended or adjusted under 35 U.S.C. 154(b) by 171 days.

(21) Appl. No.: 10/214,713

(22) Filed: Aug. 9, 2002

(65) Prior Publication Data

US 2003/0073018 A1 Apr. 17, 2003

(30) Foreign Application Priority Data

Aug. 9, 2001 (JP) ..... 2001-242725

(51) Int. Cl.[7] ..... G03G 9/087
(52) U.S. Cl. ..... 430/108.6; 430/109.4
(58) Field of Search ..... 430/108.6, 109.4

(56) References Cited

U.S. PATENT DOCUMENTS 5,234,787 A 8/1993 Morimoto et al.
6,482,561 B1 * 11/2002 Arai et al. ..... 430/108.1
6,569,590 B2 * 5/2003 Kuroda et al. ..... 430/108.6
2002/0076635 A1 6/2002 Yoshino et al.

FOREIGN PATENT DOCUMENTS

JP 59029256 A 2/1984
JP 04362956 A 12/1992
JP 09025126 A 1/1997
JP 2000010344 A 1/2000

* cited by examiner

*Primary Examiner*—John Goodrow
(74) *Attorney, Agent, or Firm*—Birch, Stewart, Kolasch & Birch, LLP

(57) ABSTRACT

A toner for electrostatic image development comprising a high-softening point polyester having a softening point of 120° C. or more and 170° C. or less; a low-softening point polyester having a softening point of 80° C. or more and less than 120° C.; and a composite oxide of two or more metals, wherein the composite oxide has a BET specific surface area of 7 $m^2/g$ or more. The toner is suitably used for the development of a latent image formed in electrophotography, electrostatic recording method, electrostatic printing method or the like.

8 Claims, No Drawings

TONER FOR ELECTROSTATIC IMAGE DEVELOPMENT

BACKGROUND OF THE INVENTION

1. Field of the Invention

The present invention relates to a toner for electrostatic image development used for the development of a latent image formed in electrophotography, electrostatic recording method, electrostatic printing method or the like.

2. Discussion of the Related Art

When toners are fixed onto paper or the like, a heat roller fixing method is generally used from the viewpoint of thermal efficiency, but an offset phenomenon is likely to be caused. In addition, lowering a lowest fixing temperature and broadening a fixable temperature range are necessitated for energy conservation, and there is earnestly desired the development of toners which are more excellent in the durability, i.e., toners with no contamination of a fixing roller after long-term use.

Conventionally, in order to improve the offset resistance, there have been tried measures against hardware such as a method comprising coating a surface of a fixing roller with a silicone rubber or a fluororesin and applying thereto a releasing agent such as a silicone oil, and those against software such as toner materials such as a method of blending polyesters having different softening points (Japanese Patent Laid-Open No. Hei 4-362956 (corresponding to U.S. Pat. No. 5,234,787)); and a method of addition of a polyvalent metal salt (Japanese Patent Laid-Open No. Sho 59-29256). However, a larger apparatus is required in the measures against external, and a sufficient fixable temperature range cannot be obtained in the measures against internal. In addition, a sufficient durability cannot be obtained in either case, so that a further improvement is desired in light of the current demand for miniaturization and higher speed.

An object of the present invention is to provide a toner for electrostatic image development which has a wide fixable temperature range and a low lowest fixing temperature, and which is excellent in the durability.

These and other objects of the present invention will be apparent from the following description.

SUMMARY OF THE INVENTION

As a result of intensive studies, the present inventors have found that the above problems can be solved by using particular polyesters and various particular composite oxides, and perfected the present invention.

The present invention relates to a toner for electrostatic image development comprising:

a high-softening point polyester having a softening point of 120° C. or more and 170° C. or less;

a low-softening point polyester having a softening point of 80° C. or more and less than 120° C.; and a composite oxide of two or more metals, wherein the composite oxide has a BET specific surface area of 7 $m^2/g$ or more.

DETAILED DESCRIPTION OF THE INVENTION

One of the features of the present invention resides in that the toner comprises two polyesters having different softening points and a composite oxide having a particular BET specific surface area. Specifically, by mixing the polyesters and the composite oxide having a particular BET specific surface area, there is caused a certain reaction between the polyesters and the composite oxide, though the causation therefor is unclear. Therefore, a decrease in the softening point by kneading can be suppressed. Further, the melt viscosity can be improved and the fixable temperature range can be drastically broadened by using two polyesters having different softening points, so that offset and toner adhesion onto a fixing roller are markedly suppressed.

In addition, the composite oxide itself has a black color, so that the composite oxide also serves as a black colorant as a substitute for carbon black.

As the raw material monomers for the polyesters, known dihydric or higher polyhydric alcohol components, and known carboxylic acid components such as dicarboxylic or higher polycarboxylic acids, carboxylic anhydrides and carboxylic acid esters are used.

The dihydric alcohol component includes a compound represented by the formula (I):

(I)

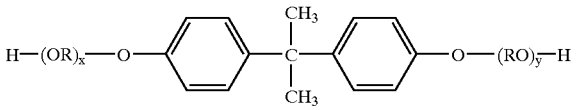

wherein R is an alkylene group having 2 or 3 carbon atoms; x and y are a positive number; and the sum of x and y is from 1 to 16, preferably from 1.5 to 5.0, including, for instance, alkylene(2 or 3 carbon atoms) oxide adducts of bisphenol A such as polyoxypropylene(2.2)-2,2-bis(4-hydroxyphenyl) propane and polyoxyethylene(2.0)-2,2-bis(4-hydroxyphenyl)propane, and the like; ethylene glycol, 1,2-propylene glycol, 1,4-butanediol, neopentyl glycol, polyethylene glycol, polypropylene glycol, hydrogenated bisphenol A, and the like.

The trihydric or higher polyhydric alcohol includes, for instance, sorbitol, pentaerythritol, glycerol, trimethylolpropane, and the like.

In both of the high-softening point polyester and the low-softening point polyester, it is preferable that the main component of the alcohol component is the compound represented by the formula (I) from the viewpoints of the triboelectric chargeability and the durability. The content of the compound represented by the formula (I) is preferably 5% by mol or more, more preferably 50% by mol or more, especially preferably 100% by mol, of the alcohol component.

Also, the dicarboxylic acid component includes aliphatic carboxylic acids such as oxalic acid, malonic acid, maleic acid, fumaric acid, citraconic acid, itaconic acid, glutaconic acid, succinic acid and adipic acid; a substituted succinic acid of which substituent is an alkyl group having 1 to 20 carbon atoms or an alkenyl group having 2 to 20 carbon atoms, such as dodecenylsuccinic acid and octylsuccinic acid; aromatic dicarboxylic acids such as phthalic acid, isophthalic acid and terephthalic acid; acid anhydrides thereof and alkyl(1 to 3 carbon atoms) esters thereof; and the like.

The tricarboxylic or higher polycarboxylic acid component includes, for instance, 1,2,4-benzenetricarboxylic acid (trimellitic acid), 2,5,7-naphthalenetricarboxylic acid, pyromellitic acid, acid anhydrides, lower alkyl(1 to 3 carbon atoms) esters thereof, and the like.

Here, the high-softening point polyester is preferably a cross-linked resin, more preferably a resin obtained by using monomers comprising a trivalent or higher polyvalent monomer. The content of the trivalent or higher polyvalent monomer is preferably from 0.05 to 40% by mol, more preferably from 1 to 35% by mol, especially preferably from 3 to 30% by mol, of an entire monomer for the high-softening point polyester.

The polyester can be prepared by, for instance, polycondensation of an alcohol component with a carboxylic acid component at a temperature of 180° to 250° C. in an inert gas atmosphere using an esterification catalyst as desired.

The polyester in the present invention comprises the high-softening point polyester and the low-softening point polyester. The high-softening point polyester has a softening point of from 120° C. or more and 170° C. or less, preferably from 130° to 170° C., more preferably from 135° to 155° C. The low-softening point polyester has a softening point of from 80° C. or more and less than 120° C., preferably from 90° to 115° C., more preferably from 95° to 110° C.

The difference in the softening points between the high-softening point polyester and the low-softening point polyester is preferably 10° C. or more, more preferably from 20° to 80° C., especially preferably from 30° to 60° C.

In the present invention, both of the high-softening point polyester and the low-softening point polyester are preferably amorphous polyesters, and the difference between the softening point and the glass transition point is preferably 20° C. or more, more preferably from 30° to 100° C.

The softening point and the glass transition point of the polyester can be adjusted by the monomer composition, the cross-linking degree, the molecular weight, or the like.

It is preferable that the polyester has an acid value of from 1 to 80 mg KOH/g, whether the polyester is a high-softening point polyester or a low-softening point polyester. Especially, in the case of positively chargeable toners, the polyester has an acid value of preferably from 1 to 20 mg KOH/g, more preferably from 3 to 10 mg KOH/g. Also, in the case of negatively chargeable toners, the polyester has an acid value of preferably from 10 to 80 mg KOH/g. Also, the polyester has a hydroxyl value of from 5 to 60 mg KOH/g, preferably from 10 to 50 mg KOH/g.

The weight ratio of the high-softening point polyester to the low-softening point polyester (high-softening point polyester/low-softening point polyester) is preferably from 5/95 to 95/5, more preferably from 20/80 to 90/10.

Each of the high-softening point polyester and the low-softening point polyester may be a mixture of a plurality of polyesters.

The content of the polyesters is preferably from 50 to 100% by weight, more preferably from 80 to 100% by weight, especially preferably 100% by weight, of the resin binder. Incidentally, the resin binder may comprise a resin such as a styrene-acrylic resin, an epoxy resin, a polycarbonate or a polyurethane in an appropriate amount.

The composite oxide in the present invention needs to be constituted by at least 2 metals in order to increase the blackened degree of the toner and to control the magnetic properties. Especially, it is preferable that at least one, preferably at least two, of the metals in the composite oxide is titanium (Ti), vanadium (V), chromium (Cr), manganese (Mn), iron (Fe), cobalt (Co), nickel (Ni), copper (Cu), magnesium (Mg), aluminum (Al) or silicon (Si). Among them, Ti, Mn, Fe, Cu , Mg, Al and Si are preferable, and Ti, Fe, Mg and Al are especially preferable. The compositional ratio of the metals in the composite oxide is not particularly limited.

The composite oxide in the present invention has a specific surface area as determined by the BET method, i.e., a BET specific surface area, of 7 $m^2/g$ or more, preferably 10 $m^2/g$ or more, more preferably 20 $m^2/g$ or more. The BET specific surface area is preferably 300 $m^2/g$ or less, more preferably 200 $m^2/g$ or less, especially preferably 100 $m^2/g$ or less, from the viewpoints of the handleability and the resistivity adjustment.

The composite oxide has an average particle size of preferably from 5 nm to 1 $\mu$m, more preferably from 5 to 500 nm, especially preferably from 5 to 300 nm, from the viewpoint of the covering strength.

The process for preparing a composite oxide includes a process comprising forming a core particle with a main oxide and depositing another oxide on a surface of the main oxide (Japanese Patent Laid-Open No. 2000-10344), a process of making a composite oxide comprising sintering several oxides (Japanese Patent Laid-Open No. Hei 9-25126), and the like, without being particularly limited thereto.

The preferable commercially available composite oxide in the present invention includes "Dye Pyroxide Black No. 1" and "Dye Pyroxide Black No. 2" (hereinabove commercially available from DAINICHISEIKA COLOR & CHEMICALS MFG. CO., LTD.), "HSB-603," "HSB-603Rx," "HSB-605" and K Series such as "K-002" (hereinabove commercially available from Toda Kogyo Corp.), MC Series (commercially available from MITSUI MINING & SMELTING CO., LTD.), and the like.

The content of the composite oxide is preferably 30 parts by weight or less, more preferably from 3 to 25 parts by weight, especially preferably from 6 to 20 parts by weight, based on 100 parts by weight of the resin binder, preferably based on 100 parts by weight of a total amount of the high-softening point polyester and the low-softening point polyester, in order to efficiently obtain the effects of the present invention. Incidentally, the toner may contain a carbon black for the purpose of supplementing the blackened degree of the toner.

Further, the toner of the present invention may comprise in appropriate amounts additives such as charge control agents, releasing agents, electric conductivity modifiers, extenders, reinforcing fillers such as fibrous substances, antioxidants, anti-aging agents, fluidity improvers, and cleanability improvers.

The toner of the present invention is preferably a pulverized toner prepared by kneading and pulverization method. For instance, the toner can be prepared by homogeneously mixing a resin binder, a colorant, and the like in a mixer such as a Henschel mixer or a ball-mill, thereafter melt-kneading with a closed kneader, a single-screw or twin-screw extruder, or a continuous double roller kneader, cooling, pulverizing and classifying the product. Furthermore, a fluidity improver and the like may be added to the toner surfaces as occasion demands. The volume-average particle size of the toner thus obtained is preferably from 3 to 15 $\mu$m.

The toner of the present invention has a softening point of preferably from 100° to 160° C., more preferably from 110° to 150° C.

The toner for electrostatic image development of the present invention can be used alone as a developer, in a case where the fine magnetic material powder is contained. Alternatively, the toner can be used as a nonmagnetic one-component developer, or the toner can be mixed with a carrier as a two-component developer, in a case where the fine magnetic material powder is not contained.

EXAMPLES

[BET Specific Surface Area of Composite Oxide]

The BET specific surface area of a composite oxide is determined by the nitrogen adsorption method.

[Softening Point of Toner]

The softening point refers to a temperature at which a half of the resin flows out, when measured by using a flow tester of the "koka" type "CFT-500D" (commercially available from Shimadzu Corporation) (sample: 1 g, rate of raising temperature: 6° C./min, load: 1.96 MPa, and nozzle: 1 mm $\phi$×1 mm).

[Softening Point of Resin]

The softening point of a resin is determined by a method according to ASTM D36-86.

[Glass Transition Point of Resin]

The glass transition point of a resin is determined using a differential scanning calorimeter "DSC Model 210" (commercially available from Seiko Instruments, Inc.) with raising the temperature at a rate of 10° C./min.

[Acid Value of Resin]

The acid value of a resin is measured by a method according to JIS K 0070.

Resin Preparation Example 1

The raw material monomers as shown in Table 1 were reacted in the presence of dibutyltin oxide as an esterification catalyst (0.25 parts by weight based on 100 parts by weight of a total amount of the raw material monomers) under nitrogen gas stream, with stirring the ingredients at 235° C. The reaction was allowed to proceed using the softening point as determined by the ring and ball method as an end point, to give resins A and C to G. The softening point, glass transition point and acid value of each of the resulting resins are shown in Table 1.

Resin Preparation Example 2

The raw material monomers as shown in Table 1 except for fumaric acid were reacted for 6 hours in the presence of dibutyltin oxide as an esterification catalyst (0.25 parts by weight based on 100 parts by weight of a total amount of the raw material monomers) under nitrogen gas stream, with stirring the ingredients at 235° C. The reaction temperature was lowered to 210° C. at a point where the water formed by the reaction was no longer generated. Fumaric acid and hydroquinone (0.05 parts by weight based on 100 parts by weight of a total amount of the raw material monomers) were supplied thereto. The reaction was allowed to proceed, with keeping the temperature at 210° C., using the softening point as determined by the ring and ball method as an end point, to give a resin B. The softening point, glass transition point and acid value of the resulting resin are shown in Table 1.

TABLE 1

| | Resin A | Resin B | Resin C | Resin D | Resin E | Resin F | Resin G |
|---|---|---|---|---|---|---|---|
| BPA-PO | 1888 | 2675 | 630 | 1800 | 1800 | | 1820 |
| BPA-EO | 755 | 30 | 2001 | 745 | 745 | | 650 |
| Ethylene Glycol | | | | | | 337 | |
| Neopentyl Glycol | | | | | | 1093 | |
| Glycerol | | | | | | | 74 |
| Terephthalic Acid | 701 | 355 | 1187 | 503 | 548 | 1830 | 1140 |
| Fumaric Acid | | 583 | | | | | |
| Trimellitic Acid | 225 | 13 | | 305 | 300 | 615 | |
| Dodecenylsuccinic Acid | 238 | | | 535 | 435 | | 230 |
| Softening Point (° C.) | 143 | 100 | 108 | 150 | 102 | 135 | 145 |
| Glass Transition Point (° C.) | 64 | 60 | 64 | 64 | 35 | 65 | 71 |
| Acid Value (mg KOH/g) | 7 | 10 | 3 | 18 | 58 | 50 | 5 |

Note)
The used amount is expressed in the unit "g."
BPA-PO: Polyoxypropylene(2.2)-2,2-bis(4-hydroxyphenyl)propane
BPA-EO: Polyoxyethylene(2.0)-2,2-bis(4-hydroxyphenyl)propane

Examples A-1 to A-12 and Comparative Examples A-1 to A-7

One-hundred parts by weight of a resin binder and a black colorant as shown in Table 2, 2 parts by weight of a charge control agent "BONTRON N-21" (commercially available from Orient Chemical Co., Ltd.), 0.5 parts by weight of "Copy Charge PSY" (commercially available from Clariant Japan K.K.) and 1 part by weight of "Carnauba Wax No. 1" (commercially available from K.K. Kato Yoko) were premixed with a Henschel Mixer. Thereafter, the mixture was melt-kneaded with a twin-screw extruder, cooled, pulverized and classified, to give a powder having a volume-average particle size of 10 μm.

To 100 parts by weight of the resulting powder, 0.3 parts by weight of a hydrophobic silica "HVK 2150" (commercially available from Clariant) were mixed and adhered with a Henschel Mixer, to give a toner. The softening point of the toner is shown in Table 2.

Thirty-nine parts by weight of the resulting toner and 1261 parts by weight of a fluoro/acrylic resin-coated ferrite carrier having a saturation magnetization of 60 $Am^2/kg$ (average particle size: 110 μm) were mixed with a Nauta Mixer, to give a two-component developer. The resulting developer was subjected to Test Examples A-1 and A-2.

TABLE 2

| | | Black Colorant | | Softening |
|---|---|---|---|---|
| | Resin Binder | Composite Oxide | Carbon Black | Point (° C.) |
| Ex. A-1 | Resin A/Resin B = 90/10 | MC-7 = 9 | — | 139 |
| Ex. A-2 | Resin A/Resin B = 70/30 | MC-7 = 9 | — | 135 |
| Ex. A-3 | Resin A/Resin B = 60/40 | MC-7 = 9 | — | 131 |
| Ex. A-4 | Resin A/Resin C = 90/10 | MC-8 = 9 | — | 140 |
| Ex. A-5 | Resin A/Resin C = 70/30 | MC-8 = 9 | — | 136 |
| Ex. A-6 | Resin A/Resin B = 60/40 | MC-7 = 6 | — | 128 |
| Ex. A-7 | Resin A/Resin B = 60/40 | MC-7 = 12 | — | 133 |
| Ex. A-8 | Resin A/Resin C = 70/30 | MC-8 = 6 | — | 134 |
| Ex. A-9 | Resin A/Resin C = 70/30 | MC-8 = 12 | — | 138 |
| Ex. A-10 | Resin B/Resin G = 30/70 | MC-7 = 12 | — | 139 |
| Ex. A-11 | Resin A/Resin B = 60/40 | MC-10 = 9 | — | 130 |
| Ex. A-12 | Resin A/Resin B = 60/40 | K-002 = 9 | — | 129 |
| Comp. Ex. A-1 | Resin A = 100 | MC-7 = 12 | — | 148 |
| Comp. Ex. A-2 | Resin A/Resin B = 60/40 | — | 12 | 122 |
| Comp. Ex. A-3 | Resin A/Resin B = 60/40 | HSB-603 = 12 | — | 121 |

TABLE 2-continued

| | Resin Binder | Black Colorant: Composite Oxide | Black Colorant: Carbon Black | Softening Point (° C.) |
|---|---|---|---|---|
| Comp. Ex. A-4 | Resin A/Resin B = 60/40 | HSB-605 = 12 | — | 122 |
| Comp. Ex. A-5 | Resin A/Resin C = 70/30 | — | 12 | 123 |
| Comp. Ex. A-6 | Resin G = 100 | MC-7 = 12 | — | 151 |
| Comp. Ex. A-7 | Resin B = 100 | MC-7 = 12 | — | 103 |

Note) All of the used amounts are expressed in parts by weight.
Carbon black: commercially available from Cabot Corporation "Monarch 880"

The BET specific surface areas and the major metals contained of the composite oxides used in Examples and Comparative Examples are shown in Table 3.

TABLE 3

| Composite Oxide | BET Specific Surface Area ($m^2/g$) | Major Metal Contained |
|---|---|---|
| MC-7 | 60.6 | Mn, Fe |
| MC-8 | 55.4 | Mn, Fe |
| MC-10 | 56.7 | Mg, Al, Fe, Ti, Fe |
| K-002 | 12.3 | Ti, Fe |
| Dye Pyroxide Black No. 1 (Dye Pyro 1) | 28.4 | Cu, Mn, Fe |
| Dye Pyroxide Black No. 2 (Dye Pyro 2) | 56.0 | Cu, Mn, Fe |
| HSB-603 | 2.8 | Mn, Fe |
| HSB-605 | 6.0 | Mn, Fe |

Test Example A-1

A two-component developer was loaded in a contact two-component development device "Infoprint 4000 ID3, ID4" (commercially available from IBM Japan, Ltd., linear speed: 1509 mm/sec, resolution: 240 dpi, development system: 3 magnet rollers and selenium photoconductor, reversal development, DUPLEX SYSTEM). A 100000-sheet, 250000-sheet, 500000-sheet, 1000000-sheet, 1500000-sheet, or 2000000-sheet continuous printing with a printing pattern having 25% blackened ratio was carried out using a continuous feeding paper with 11×18 inches. There was visually observed whether or not toner adhesion was generated onto a fixing roller, and thereby the contamination of the fixed image was generated. The number of the printing sheets in which an image contamination was generated was used as an index of the durability. The results are shown in Table 4.

Test Example A-2

For the purpose of investigating the heat-fixing ability in detail, a two-component developer was loaded in a copy machine (modified apparatus of a copy machine commercially available from KYOCERA CORPORATION, LS-1550; amorphous silicon photoconductor; fixing roller having a rotational speed of 325 mm/sec, set to have variable temperatures of the fixing roller in the fixing device, and an oil applying device being removed therefrom). With sequentially increasing the temperature of the fixing roller from 90° to 240° C., an image printing was carried out, to determine the lowest fixing temperature and the hot-offset generating temperature by the methods described below. The results are shown in Table 4, together with the fixable temperature range obtained from the difference between the lowest fixing temperature and the hot-offset generating temperature. Here, the lower the lowest fixing temperature, the more preferable. In addition, the hot-offset generating temperature is required to be 240° C. or higher, taking into consideration heat accumulation in the fixing roller.

[Lowest Fixing Temperature]

The lowest fixing temperature used herein refers to the temperature of the fixing roller at which the ratio between two optical reflective densities (optical reflective density after eraser treatment/optical reflective density before eraser treatment) initially exceeds 70% when a sand-rubber eraser to which a load of 500 g is applied, the eraser having a bottom area of 15 mm×7.5 mm, is moved backward and forward five times over a fixed image obtained through the fixing device, and the optical reflective densities of the image before and after the eraser treatment are measured with a reflective densitometer "RD-915" commercially available from Macbeth Process Measurements Co.

[Hot-Offset Generating Temperature]

Image printing is carried out at each temperature, and thereafter continuously blank image-transfer paper is conveyed through the fixing roller under the same conditions as above. The "hot offset generating temperature" refers to a temperature of the fixing roller at which toner dusts are generated on the blank paper for the first time.

TABLE 4

| | Lowest Fixing Temperature (° C.) | Hot-Offset Generating Temperature[1)] (° C.) | Fixable Temperature Range (° C.) | Durability[2)] (× 1000 sheets) |
|---|---|---|---|---|
| Ex. A-1 | 155 | 240< | 85< | 2000< |
| Ex. A-2 | 150 | 240< | 90< | 2000< |
| Ex. A-3 | 145 | 240< | 95< | 2000< |
| Ex. A-4 | 155 | 240< | 85< | 2000< |
| Ex. A-5 | 151 | 240< | 89< | 2000< |
| Ex. A-6 | 143 | 240< | 97< | 2000< |
| Ex. A-7 | 146 | 240< | 94< | 2000< |
| Ex. A-8 | 150 | 240< | 90< | 2000< |
| Ex. A-9 | 151 | 240< | 89< | 2000< |
| Ex. A-10 | 153 | 240< | 87< | 2000< |
| Ex. A-11 | 146 | 240< | 96< | 2000< |
| Ex. A-12 | 157 | 240< | 96< | 2000< |
| Comp. Ex. A-1 | 166 | 240< | 74< | 2000< |
| Comp. Ex. A-2 | 140 | 180 | 40 | 1500 |
| Comp. Ex. A-3 | 143 | 190 | 47 | 1500 |
| Comp. Ex. A-4 | 142 | 190 | 48 | 1500 |
| Comp. Ex. A-5 | 146 | 180 | 34 | 1500 |
| Comp. Ex. A-6 | 168 | 240< | 72< | 2000< |
| Comp. Ex. A-7 | 125 | 130 | 5 | 5 |

1)"240<" means that offset is not generated even at 240° C.
2)"2000<" means that there is no problem with the durability for even 2000000 sheets.

Examples B-1 to B-9 and Comparative Examples B-1 and B-2

One-hundred parts by weight of a resin binder and a black colorant as shown in Table 5, 1 part by weight of a charge control agent "S-34" (commercially available from Orient Chemical Co., Ltd.) and 1 part by weight of "Carnauba Wax No. 1" (commercially available from K.K. Kato Yoko) were pre-mixed with a Henschel Mixer. Thereafter, the mixture was melt-kneaded with a twin-screw extruder, cooled, pulverized and classified, to give a powder having a volume-average particle size of 10 $\mu$m.

To 100 parts by weight of the resulting powder, 0.5 parts by weight of a hydrophobic silica "R-972" (commercially available from Nippon Aerosil) were mixed and adhered with a Henschel Mixer, to give a toner. The softening point of the toner is shown in Table 5. The resulting toner was subjected to Test Examples B-1 and B-2.

TABLE 5

| | Resin Binder | Black Colorant | | Softening Point (° C.) |
|---|---|---|---|---|
| | | Composite Oxide | Carbon Black | |
| Ex. B-1 | Resin D/Resin E = 50/50 | Dye Pyro 2 = 10 | — | 137 |
| Ex. B-2 | Resin D/Resin E = 30/70 | Dye Pyro 2 = 10 | — | 128 |
| Ex. B-3 | Resin D/Resin E = 50/50 | Dye Pyro 1 = 10 | — | 135 |
| Ex. B-4 | Resin D/Resin B = 30/70 | Dye Pyro 1 = 10 | — | 124 |
| Ex. B-5 | Resin D/Resin E = 30/70 | Dye Pyro 1 = 20 | — | 128 |
| Ex. B-6 | Resin D/Resin E = 30/70 | Dye Pyro 2 = 20 | — | 130 |
| Ex. B-7 | Resin F/Resin B = 70/30 | MC-8 = 9 | — | 125 |
| Ex. B-8 | Resin F/Resin B = 70/30 | MC-10 = 9 | — | 126 |
| Ex. B-9 | Resin F/Resin B = 70/30 | K-002 = 9 | — | 127 |
| Comp. Ex. B-1 | Resin D/Resin E = 50/50 | — | 10 | 125 |
| Comp. Ex. B-2 | Resin F/Resin B = 70/30 | — | 9 | 116 |

Test Example B-1

The resulting toner was fed in a monocomponent development device "Microline 703 N-3" (commercially available from Oki Data Corporation). A copying test was carried out with a blackened ratio of 25%, and a 100000-sheet continuous printing was carried out using a continuous feeding paper with 11×18 inches. There was visually observed whether or not toner adhesion was generated onto a fixing roller, and thereby the contamination of the fixed image was generated. The number of the printing sheets in which an image contamination was generated was used as an index of the durability. The results are shown in Table 6.

Test Example B-2

For the purpose of investigating the heat-fixing ability in detail, a developer was loaded in a copy machine (modified apparatus of a copy machine commercially available from Sharp Corporation, SF 9800; amorphous selenium photoconductor; fixing roller having a rotational speed of 265 mm/sec, set to have variable temperatures of the fixing roller in the fixing device, and an oil applying device being removed therefrom). With sequentially increasing the temperature of the fixing roller from 90° to 240° C., an image printing was carried out, to determine the lowest fixing temperature and the hot-offset generating temperature in the same manner as in Test Example A-2. The results are shown in Table 6, together with the fixable temperature range obtained from the difference between the lowest fixing temperature and the hot-offset generating temperature.

TABLE 6

| | Lowest Fixing Temperature (° C.) | Hot-Offset Generating Temperature[1)] (° C.) | Fixable Temperature Range (° C.) | Durability[2)] (× 1000 sheets) |
|---|---|---|---|---|
| Ex. B-1 | 158 | 240< | 82< | 100< |
| Ex. B-2 | 150 | 240< | 90< | 100< |
| Ex. B-3 | 156 | 240< | 84< | 100< |
| Ex. B-4 | 148 | 240< | 92< | 100< |
| Ex. B-5 | 150 | 240< | 90< | 100< |
| Ex. B-6 | 153 | 240< | 87< | 100< |
| Ex. B-7 | 141 | 240< | 99< | 100< |
| Ex. B-8 | 140 | 240< | 99< | 100< |
| Ex. B-9 | 141 | 240< | 98< | 100< |
| Comp. Ex. B-1 | 151 | 200 | 49 | 50 |
| Comp. Ex. B-2 | 138 | 170 | 32 | 50 |

[1)]"240<" means that offset is not generated even at 240° C.
[2)]"100<" means that there is no problem with the durability for even 100000 sheets.

It is seen from the above results that the toners of Examples have a high hot-offset generating temperature in spite of a low lowest fixing temperature, i.e. a wide fixable temperature range, and are excellent in the durability, as compared to the toners of Comparative Examples.

According to the present invention, there can be provided a toner for electrostatic image development which has a wide fixable temperature range and a low lowest fixing temperature, and is excellent in the durability.

What is claimed is:

1. A toner for electrostatic image development comprising:

a high-softening point polyester having a softening point of 120° C. or more and 170° C. or less;

a low-softening point polyester having a softening point of 80° C. or more and less than 120° C.; and a composite oxide of two or more metals, wherein the composite oxide has a BET specific surface area of 7 $m^2/g$ or more.

2. The toner according to claim 1, wherein the high-softening point polyester is a resin obtained by using monomers comprising a trivalent or higher polyvalent monomer in an amount of from 0.05 to 40% by mol of an entire monomer, and wherein each of the high-softening point polyester and the low-softening point polyester is an amorphous polyester having an acid value of from 1 to 80 mg KOH/g.

3. The toner according to claim 1, wherein the metal constituting the composite oxide is at least one member selected from the group consisting of titanium (Ti), vanadium (V), chromium (Cr), manganese (Mn), iron (Fe), cobalt (Co), nickel (Ni), copper (Cu), magnesium (Mg), aluminum (Al) and silicon (Si).

4. The toner according to claim 1, wherein a weight ratio of the high-softening point polyester to the low-softening point polyester is from 5/95 to 95/5.

5. The toner according to claim 1, wherein a difference in the softening points between the high-softening point polyester and the low-softening point polyester is 10° C. or more.

6. The toner according to claim 1, wherein a difference between the softening point and the glass transition point in each of the high-softening point polyester and the low-softening point polyester is 20° C. or more.

7. The toner according to claim 1, wherein the composite oxide has an average particle size of from 5 nm to 1 $\mu$m.

8. The toner according to claim 1, wherein the composite oxide is contained in an amount of 30 parts by weight or less, based on 100 parts by weight of a total amount of the high-softening point polyester and the low-softening point polyester.

* * * * *